US010687615B2

(12) United States Patent
Yu et al.

(10) Patent No.: US 10,687,615 B2
(45) Date of Patent: Jun. 23, 2020

(54) LIFTING TABLE

(71) Applicant: SHAOXING CONTUO TRANSMISSION TECHNOLOGY CO., LTD., Shaoxing (CN)

(72) Inventors: Jianjun Yu, Shaoxing (CN); Xinfeng Zhang, Shaoxing (CN); Jiandong Zhu, Shaoxing (CN)

( * ) Notice: Subject to any disclaimer, the term of this patent is extended or adjusted under 35 U.S.C. 154(b) by 0 days.

(21) Appl. No.: 16/139,037

(22) Filed: Sep. 23, 2018

(65) Prior Publication Data

US 2019/0021486 A1 Jan. 24, 2019

Related U.S. Application Data

(63) Continuation of application No. PCT/CN2017/107404, filed on Oct. 24, 2017.

(30) Foreign Application Priority Data

Oct. 25, 2016 (CN) ..... 2016 2 1163287 U

(51) Int. Cl.
*A47B 21/02* (2006.01)
*A47B 13/02* (2006.01)
(Continued)

(52) U.S. Cl.
CPC ..... *A47B 21/02* (2013.01); *A47B 9/00* (2013.01); *A47B 9/20* (2013.01); *A47B 13/02* (2013.01);
(Continued)

(58) Field of Classification Search
CPC ..... A47B 9/20; A47B 9/10; A47B 47/021; A47B 57/06; A47B 57/10; A47B 57/20; A47B 57/30; A47B 57/34; A47B 57/485
(Continued)

(56) References Cited

U.S. PATENT DOCUMENTS 3,302,927 A * 2/1967 Gray ..... B66F 7/04 254/2 B
5,443,017 A 8/1995 Wacker et al.
(Continued)

FOREIGN PATENT DOCUMENTS

CN 2659226 Y 12/2004
CN 202286969 U 7/2012
(Continued)

OTHER PUBLICATIONS

Internation Search Report of PCT/CN2017/107404, dated Dec. 14, 2017.

*Primary Examiner* — Janet M Wilkens
(74) *Attorney, Agent, or Firm* — Erson IP (Nelson IP)

(57) ABSTRACT

A lifting table includes a lifting mechanism, a base, an upper tabletop and a tabletop mounting frame assembly; the lifting mechanism includes a plurality sections of lifting columns and a controller, and the lifting columns are matched and connected with one another; the base is installed at a bottom of the lifting mechanism, the controller is hidden in the base and connected with buttons on the tabletop mounting frame assembly; the upper tabletop and the tabletop mounting frame assembly are both installed on lifting columns, and the tabletop mounting frame assembly is located below the upper tabletop; through selection of buttons on the tabletop mounting frame assembly, a signal is sent to the controller so that the controller drives the lifting columns to stretch out or draw back and hence to drive the upper tabletop and the tabletop mounting frame assembly to raise up or lower down.

8 Claims, 5 Drawing Sheets

(51) Int. Cl.
*A47B 9/20* (2006.01)
*A47B 21/04* (2006.01)
*A47B 9/00* (2006.01)

(52) U.S. Cl.
CPC ..... *A47B 21/04* (2013.01); *A47B 2200/0054* (2013.01); *A47B 2200/0056* (2013.01)

(58) Field of Classification Search
USPC ..... 312/196, 233, 277, 223.3, 7.2; 108/50.01, 50.02, 90, 93, 106, 147, 108/147.19, 147.21; 248/149, 157, 917; 211/187, 153, 134
See application file for complete search history.

(56) References Cited

U.S. PATENT DOCUMENTS 7,690,317 B2 * 4/2010 Beck ..... A47B 21/0314 108/137
8,181,920 B2 * 5/2012 Brown ..... G06Q 99/00 108/50.01
8,814,120 B1 * 8/2014 Kleespie ..... B65D 90/12 108/57.31
8,826,831 B2 * 9/2014 Hazzard ..... A47B 21/02 108/50.01
9,133,974 B2 * 9/2015 Tholkes ..... F16M 11/046
9,366,379 B2 * 6/2016 Bowman ..... F16M 11/045
2006/0138298 A1 * 6/2006 Yuan ..... F16M 11/10 248/371
2007/0158627 A1 * 7/2007 Dittmer ..... F16M 11/18 254/124
2007/0252919 A1 * 11/2007 McGreevy ..... F16M 11/10 348/825
2016/0073779 A1 * 3/2016 Ringlein ..... A47B 87/002 108/28
2017/0007017 A1 * 1/2017 Herring ..... A47B 21/02

FOREIGN PATENT DOCUMENTS

CN 203709527 U 7/2014
CN 204393705 U 6/2015
CN 204861796 U 12/2015
CN 205597457 U 9/2016
CN 206413973 U 8/2017
EP 2160958 * 3/2010
WO 2006050735 A1 5/2006

* cited by examiner

LIFTING TABLE

CROSS-REFERENCE TO RELATED APPLICATIONS

This application is a continuation of International Patent Application No. PCT/CN2017/107404 with a filing date of Oct. 24, 2017, designating the United States, now pending, and further claims priority to Chinese Patent Application No. 201621163287.0 with a filing date of Oct. 25, 2016. The content of the aforementioned applications, including any intervening amendments thereto, are incorporated herein by reference.

TECHNICAL FIELD

The present disclosure relates to a lifting table, belonging to the technical field of desks with adjustable desktop height.

BACKGROUND OF THE PRESENT INVENTION

The lifting desk table is a common facility in daily application, and is often used as a student desk, office furniture or even traffic utensil due to its adjustable height, such as an electric lifting desk provided in Chinese patent No. 2015205672715 and a wireless remote control electric lifting desk provided in Chinese patent No. 201420076481.X. These lifting desks are convenient in application, and fast and convenient to manipulate, and hence are general in use. However, this facility also has obvious defects, for example, because of its excessively simple function, this facility only achieves simple loading and a height adjusting function, and for teaching, office and daily use, other facilities are also needed for matching so as to accomplish complete work; the lifting of this facility depends on a telescopic arm, and its stability cannot be ensured, and thus a collapse or toppling phenomenon occurs once load is slightly excessive.

In view of this, the present application is made.

SUMMARY OF PRESENT INVENTION

Aiming at the above defects of the existing lifting desks, the present disclosure provides a lifting table which is convenient to manipulate, wide in height adjusting range and good in stability.

In order to realize the above object, the present disclosure adopts the following technical solutions:

A lifting table, includes a lifting mechanism, a base, an upper tabletop and a tabletop mounting frame assembly; the lifting mechanism includes a plurality sections of lifting columns and a controller, and the lifting columns are matched and connected with one another; the base is installed at a bottom of the lifting mechanism, the controller is hidden in the base and connected with buttons on the tabletop mounting frame assembly; the upper tabletop and the tabletop mounting frame assembly are both installed on the lifting columns of the lifting mechanism, and the tabletop mounting frame assembly is located below the upper tabletop; through selection of the buttons on the tabletop mounting frame assembly, a signal is sent to the controller so that the controller drives the lifting columns to stretch out or draw back and hence to drive the upper tabletop and the tabletop mounting frame assembly to raise up or lower down.

Further, preferably, the lifting columns include an inner column, a middle column and an outer column in turn from bottom to top, the base and the controller are both provided to the inner column with the controller located below the base; an first installation hole is defined at a position of the upper tabletop corresponding to the outer column, and the upper tabletop sleeves on the outer column via the first installation hole; the tabletop mounting frame assembly is fixed with the outer column so that the tabletop mounting frame assembly is installed under the upper tabletop to support and fix the upper tabletop. More preferably, the side wall of the outer column is provided with mounting cushion blocks, the mounting cushion blocks support the upper tabletop at the two sides of the upper tabletop, the tabletop mounting frame assembly supports the upper tabletop under the upper tabletop, the mounting cushion blocks are matched with the tabletop mounting frame assembly to form a triangular fixation structure to ensure the stability of the upper tabletop.

The tabletop mounting frame assembly is in a "Z" shape and comprises a tabletop mounting plate, an extending plate and a lower tabletop; a second installation hole is defined at a position of the tabletop mounting frame assembly corresponding to the outer column, and the tabletop mounting frame assembly is fixed to the outer column via the second installation hole; the tabletop mounting plate is arranged under the upper tabletop for supporting and fixing the upper tabletop; and the tabletop mounting plate and the lower tabletop are both arranged in parallel to the upper tabletop, the extending plate is obliquely connected between the tabletop mounting plate and the lower tabletop, and the buttons are arranged on the oblique extending plate to facilitate manipulation. The lower tabletop extends beyond the upper tabletop via the extending plate for placing objects such as keyboard, cursor mouse, books and the like.

The base is of a trapezoidal structure whose bottom is hollow and is used for receiving the controller. The base is designed in the trapezoidal structure in which the flat top can be used for placing articles as a backup desktop, the hollow bottom is used for receiving the controller, so that the precise component controller can be protected from being interfered by external, and the outer cover of the controller can be formed to take an effect of protecting.

The bottom of the base is provided with a base mounting plate for fixing and protecting the controller. For setting of the base mounting plate, the base mounting plate not only can be used as a gravity balancing block to better balance the whole device and ensure the stability, but also can protect the controller installed in the base so as to improve the service life of the precise component.

A display bracket is installed on a top of the outer column and, used for suspending and fixing articles such as a projector and a computer. More preferably, the top of the outer column protrudes over the upper tabletop, which is convenient to suspend and fix, and meanwhile, the upper tabletop under the lower part takes an effect of protecting to prevent suspended articles from dropping and being damaged.

In the figures: 1. lifting mechanism; 11. inner column; 12. middle column; 13. outer column; 14. controller, 2. base; 3. upper tabletop; 31. installation hole; 4. tabletop mounting frame assembly; 41. tabletop mounting plate; 42. extending plate; 43. button; 44. lower tabletop; 45. installation hole; 5. mounting cushion block; 6. base mounting plate; 7. display bracket; 71. fixing hole; 72. suspending hole; 7*a*. fixing base; and 7*b*. fixing surface.

DETAILED DESCRIPTION OF PREFERRED EMBODIMENTS

Embodiment 1

Figure 1:
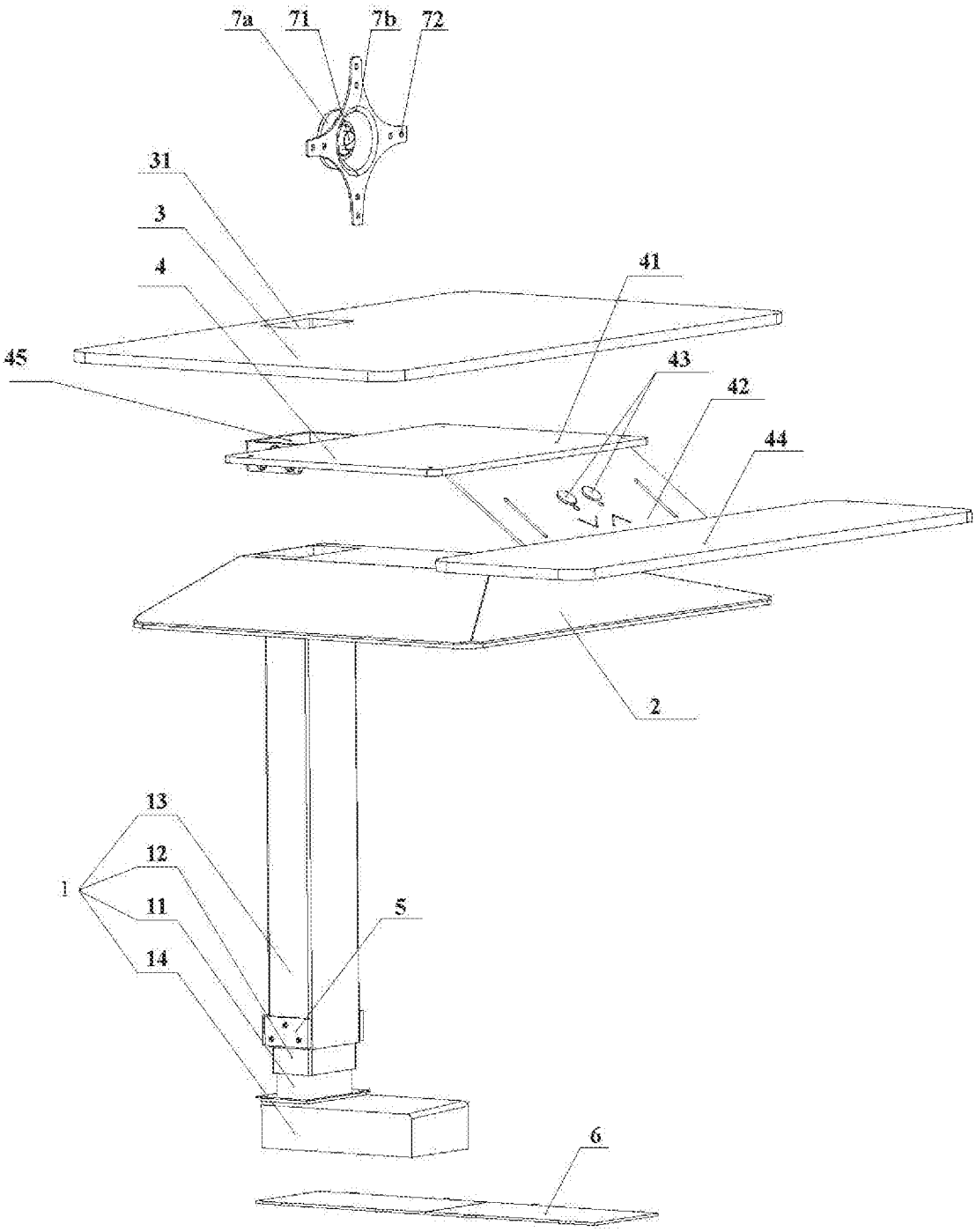
FIG. 1 is a schematic diagram of a splitting structure of a lifting table according to the present disclosure.
Figure 2:
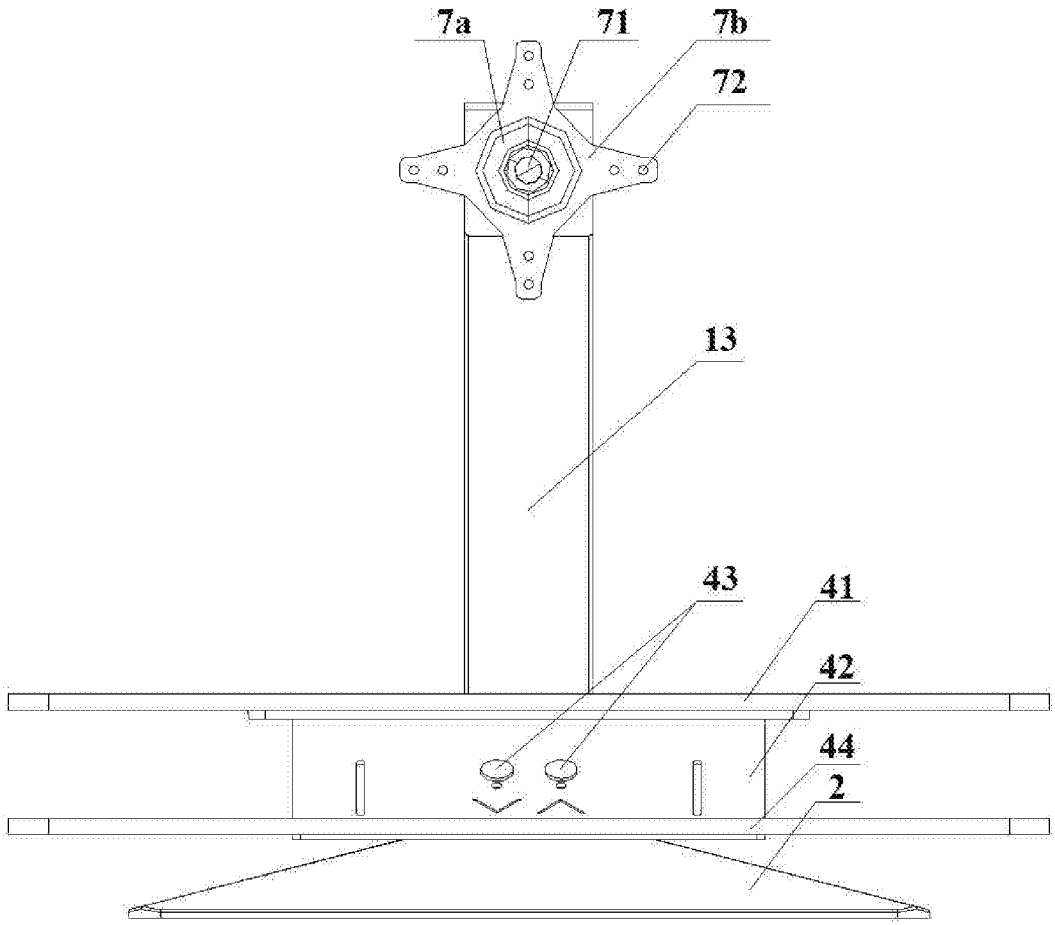
FIG. 2 is a front view of the lifting table according to the present disclosure.
Figure 3:
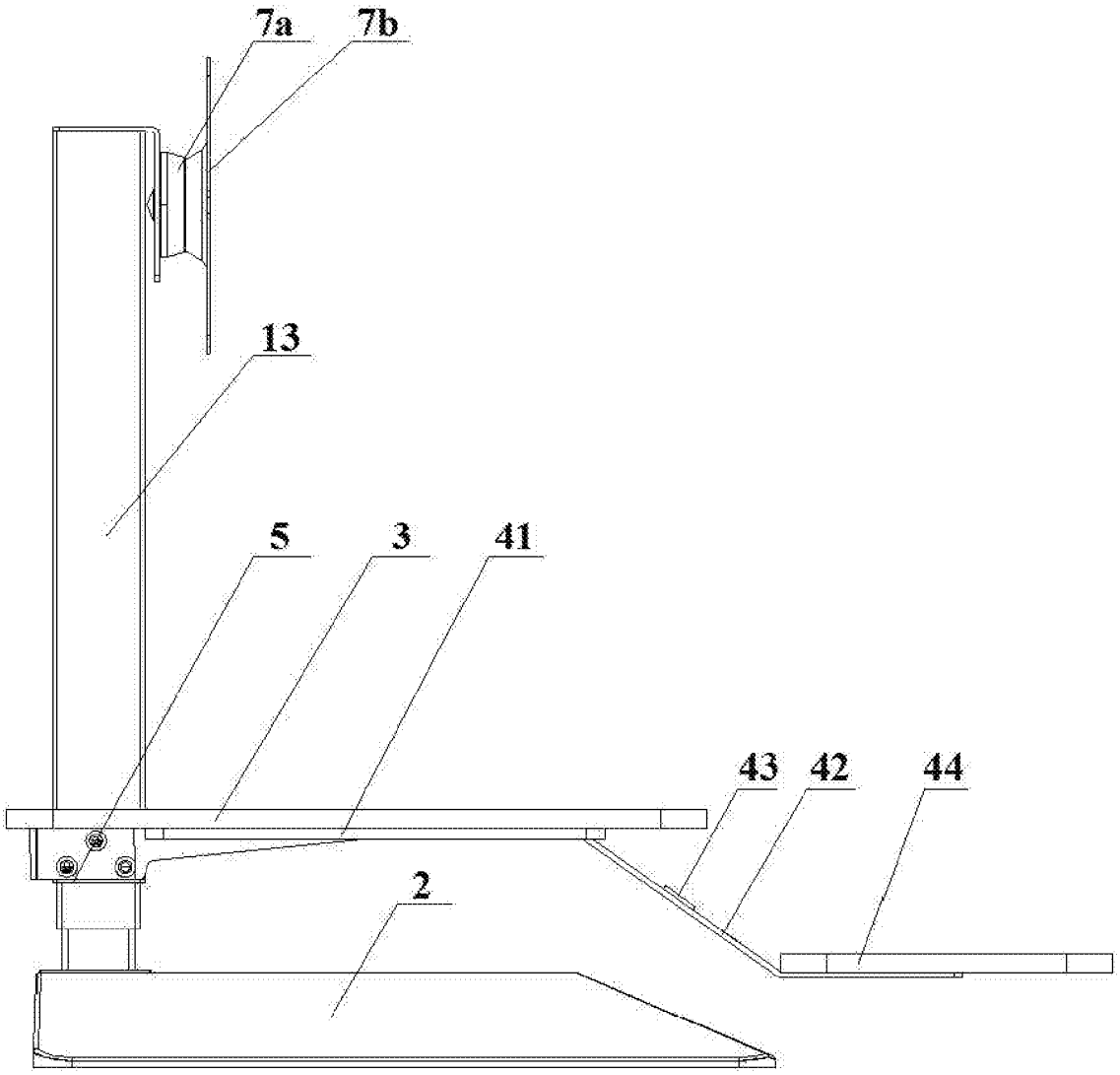
FIG. 3 is a side view of the lifting table according to the present disclosure.

Referring to FIGS. 1-3, in this embodiment, a lifting table includes a lifting mechanism 1, a base 2, an upper tabletop 3 and a tabletop mounting frame assembly 4. The lifting mechanism 1 includes an inner column 11, a middle column 12 and an outer column 13 and a controller 14. The inner column 11, the middle column 12 and the outer column 13 are installed in turn. The base 2 and the controller 14 are both installed on the inner column 11, and the controller 14 is located at a bottom of the base 2 and connected with buttons 21 on the tabletop mounting frame assembly 4. An installation hole 31 is defined at a position of the upper tabletop 3 corresponding to the outer column 13, and the upper tabletop 3 sleeves on the outer column 13 via this installation hole 31. The tabletop mounting frame assembly 4 is fixed with the outer column 13 so that the tabletop mounting frame assembly is installed under the upper tabletop 3 to support and fix the upper tabletop 3.

When in a storage state, the middle column 12 and the outer column 13 are both contracted into the inner column 11, or in anon-stretching state. At this moment, the whole device is small in height and small in occupied area for storage. When operation is needed, a button 43 with a function of ascending arranged the tabletop mounting frame assembly 4 is started, this button 43 sends a signal to the controller 14, the controller 14 drives the middle bottom 12 to upwardly stretch and drives the upper tabletop 3 to ascend to a proper height so as to be used; when the height is still not sufficient, pressing the button 43 with a function of ascending continuously; the outer column 13 will hence upwardly stretch until the upper tabletop 3 ascends to the highest position. At the end of use or when the height is over high, pressing a button with a function of descending, the outer column 13 and the middle column 12 are respectively contracted and descend, and hence drive the upper tabletop 3 to descend to a proper height.

The tabletop mounting frame assembly 4 is in a "Z" shape and comprises a tabletop mounting plate 41, an extending plate 42 and a lower tabletop 44. A second installation 45 hole is defined at a position of the tabletop mounting frame assembly 4 corresponding to the outer column 13, and the tabletop mounting frame assembly 4 is fixed to the outer column 13 via the second installation hole 45. The tabletop mounting plate 41 is arranged under the upper tabletop 3 for supporting and fixing the upper tabletop 3. The tabletop mounting plate 41 and the lower tabletop 44 are both arranged in parallel to the upper tabletop 3. The extending plate 42 is obliquely connected between the tabletop mounting plate 41 and the lower tabletop 44. The buttons 43 are arranged on the oblique extending plate 42 to facilitate manipulation. The lower tabletop 44 extends beyond the upper tabletop 3 via the extending plate 42 for placing objects such as keyboard, cursor mouse, books and the like.

Embodiment 2

Setting and working principles of this embodiment are the same as those of embodiment 1, and the difference is in that the side wall of the outer column 13 is provided with mounting cushion blocks 5. The mounting cushion blocks 5 provide support at the two sides of the upper tabletop, the tabletop mounting frame assembly 4 provides support under the upper tabletop 3, the mounting cushion blocks 5 are matched with the tabletop mounting frame assembly 4 to form a triangular fixation structure to ensure the stability of the upper tabletop 3.

Embodiment 3

Figure 4:
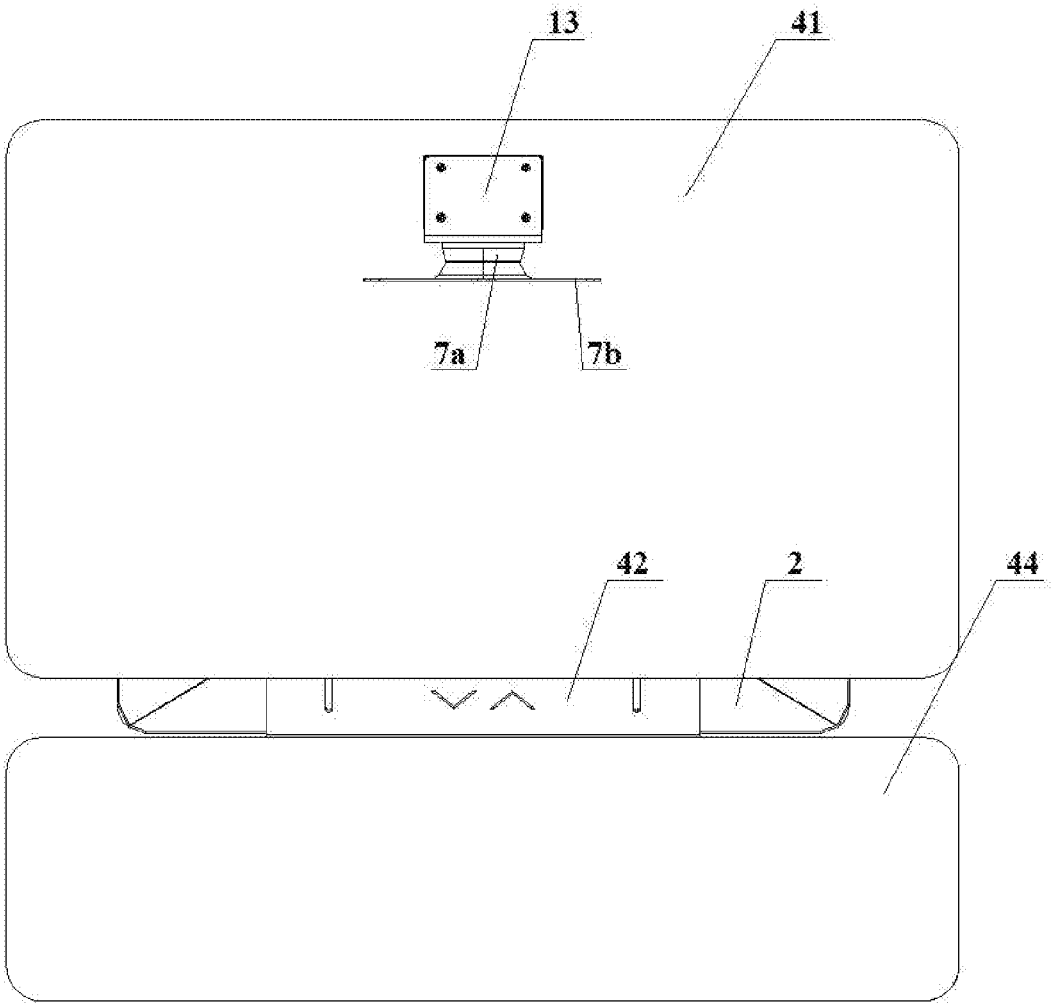
FIG. 4 is a top view of the lifting table according to the present disclosure.
Figure 5:
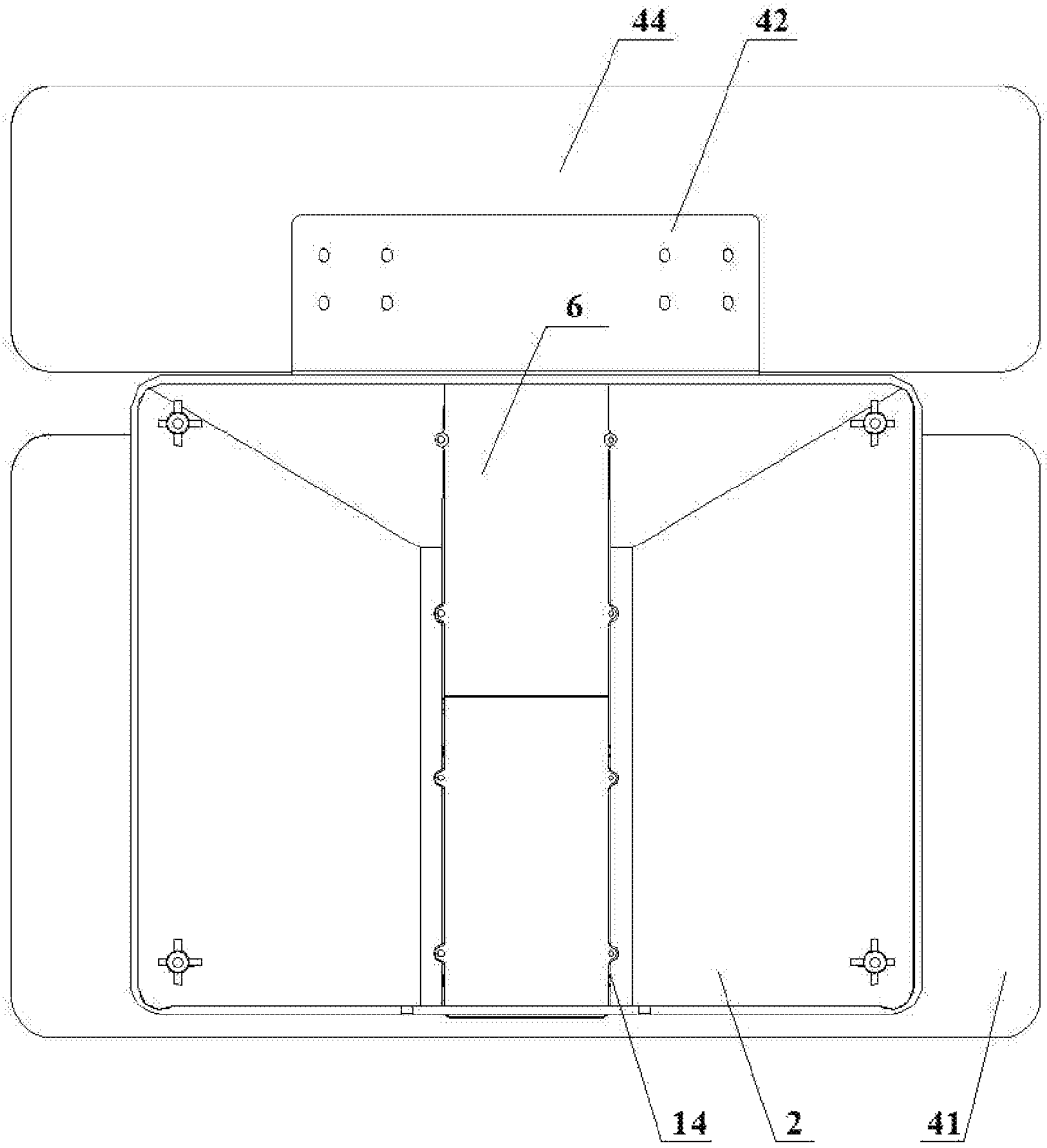
FIG. 5 is a bottom view of the lifting table according to the present disclosure.

Setting and working principles of this embodiment are the same as those of embodiment 1, and referring to FIG. 4, the difference is in that the base 2 is of a trapezoidal structure whose bottom is hollow and is used for receiving the controller 14. The base 2 is designed in the trapezoidal structure in which the flat top can be used for placing articles as a backup desktop, and the hollow bottom is used for receiving the controller 14, so that the precise component controller 14 can be protected, from being interfered by external, and the outer cover of the controller 14 can be formed to take an effect of protecting. The bottom of the base 2 is provided with a base mounting plate 6 for fixing and protecting the controller 14. The base mounting plate 6 not only can be used as a gravity balancing block to better balance the whole device and ensure the stability, but also can protect the controller 14 installed in the base 2 so as to improve the service life of the precise component.

Embodiment 4

Setting and working principles of this embodiment are the same as those of embodiment 1, and the difference is in that a display bracket 7 is installed on the outer column 13. The display bracket 7 is formed by a fixing base 7*a* and a fixing surface 7*b*, the fixing base 7*a* and the fixing surface 7*b* are respectively provided with fixing holes 71 and suspending holes 72, the fixing surface 7*b* is in parallel to a surface of the outer column 13, and the display bracket 7 is fixed with the outer column 13 via the fixing holes 71. Articles such as a projector and a computer are suspended and fixed via the suspending holes 72, for convenient use, the top of the outer column 13 protrudes over the installation hole 31 of the upper tabletop 3 to facilitate suspension and fixation, and meanwhile, the upper tabletop 3 located on the lower part can take an effect of protecting to prevent suspended articles from dropping and being damaged.

Embodiment 5

Setting and working principles of this embodiment are the same as those of embodiment 1, and the difference is in that the side wall of the outer column 13 is provided with mounting cushion blocks 5, the mounting cushion blocks 5 provide support at the two sides of the upper tabletop, the tabletop mounting frame assembly 4 provides support under the upper tabletop 3, and the mounting cushion blocks 5 are matched with the tabletop mounting frame assembly 4 to form a triangular fixation structure to ensure the stability of the upper tabletop 3. Referring to FIG. 4, the base 2 is of a trapezoidal structure whose bottom is hollow and is used for receiving the controller 14. The base 2 is designed in the trapezoidal structure in which the flat top can be used for placing articles as a backup desktop, and the hollow bottom is used for receiving the controller 14, so that the precise component controller 14 can be protected from being interfered by external, and the outer cover of the controller 14 can be formed to take an effect of protecting. The bottom of the base 2 is provided with a base mounting plate 6 for fixing and protecting the controller 14. The base mounting plate not only can be used as a gravity balancing block to better balance the whole device and ensure the stability, but also can protect the controller 14 installed in the base 2 so as to improve the service life of the precise component.

Embodiment 6

Setting and working principles of this embodiment are the same as those of embodiment 1, and the difference is in that the side wall of the outer column 13 is provided with mounting cushion blocks 5, the mounting cushion blocks 5 provide support at the two sides of the upper tabletop, the tabletop mounting frame assembly 4 provides support under the upper tabletop 3, and the mounting cushion blocks 5 are matched with the tabletop mounting frame assembly 4 to form a triangular fixation structure to ensure the stability of the upper tabletop 3. A display bracket 7 is installed on the outer column 13, the display bracket 7 is formed by a fixing base 7*a* and a fixing surface 7*b*, the fixing base 7*a* and the fixing surface 7*b* are respectively provided with fixing holes 71 and suspending holes 72, the fixing surface 7*b* is in parallel to a surface of the outer column 13, and the display bracket 7 is fixed with the outer column 13 via the fixing holes 71. Articles such as a projector and a computer are suspended and fixed via the suspending holes 72, for convenient use, the top of the outer column 13 protrudes over the installation hole 31 of the upper tabletop 3 to facilitate suspension and fixation, and meanwhile, the upper tabletop 3 located on the lower part can take an effect of protecting to prevent suspended articles from dropping and being damaged.

Embodiment 7

Setting and working principles of this embodiment are the same as those of embodiment 1, and the difference is in that the side wall of the outer column 13 is provided with mounting cushion blocks 5, the mounting cushion blocks 5 provide support at the two sides of the upper tabletop, the tabletop mounting frame assembly 4 provides support under the upper tabletop 3, and the mounting cushion blocks 5 are matched with the tabletop mounting frame assembly 4 to form a triangular fixation structure to ensure the stability of the upper tabletop 3. A display bracket 7 is installed on the outer column 13, the display bracket 7 is formed by a fixing base 7*a* and a fixing surface 7*b*, the fixing base 7*a* and the fixing surface 7*b* are respectively provided with fixing holes 71 and suspending holes 72, the fixing surface 7*b* is in parallel to a surface of the outer column 13, and the display bracket 7 is fixed with the outer column 13 via the fixing holes 71. Articles such as a projector and a computer are suspended and fixed via the suspending holes 72, for convenient use, the top of the outer column 13 protrudes over the installation hole 31 of the upper tabletop 3 to facilitate suspension and fixation, and meanwhile, the upper tabletop 3 located on the lower part can take an effect of protecting to prevent suspended articles from dropping and being damaged. Referring to FIG. 4, the base 2 is of a trapezoidal structure whose bottom is hollow and is used for receiving the controller 14. The base 2 is designed in the trapezoidal structure in which the flat top can be used for placing articles as a backup desktop, and the hollow bottom is used for receiving the controller 14, so that the precise component controller 14 can be protected from being interfered by external, and the outer cover of the controller 14 can be formed to take an effect of protecting. The bottom of the base 2 is provided with a base mounting plate 6 for fixing and protecting the controller 14. The base mounting plate not only can be used as a gravity balancing block to better balance the whole device and ensure the stability, but also can protect the controller 14 installed in the base 2 so as to improve the service life of the precise component.

The above contents are further detailed description, made to the technical solution provided in combination with preferred embodiments of the present disclosure. However, the embodiments of the present disclosure are not limited thereto. For those of ordinary skill in the art, several simple deduction or substitutions may be made without departing from the concept of the present disclosure, all of which should be considered to be included in the protection scope of the present disclosure, which is defined in the appended claims.

We claim:

1. A lifting table, comprising a lifting mechanism, a base, an upper tabletop and a tabletop mounting frame assembly, wherein the lifting mechanism includes a plurality sections of lifting columns and a controller, and the lifting columns are matched and connected with one another; the base is installed at a bottom of the lifting mechanism, the controller is hidden in the base and connected with buttons on the tabletop mounting frame assembly; the upper tabletop and the tabletop mounting frame assembly are both installed on the lifting columns of the lifting mechanism, and the tabletop mounting frame assembly is located below the upper tabletop; through selection of buttons on the tabletop mounting frame assembly, a signal is sent to the controller so that the controller drives the lifting columns to stretch out or draw back and hence to drive the upper tabletop and the tabletop mounting frame assembly to raise up or lower down; wherein, the lifting columns comprise an inner column, a middle column and an outer column in turn from bottom to top, the base and the controller are both provided to the inner column with the controller located below the base; a first installation hole is defined at a position of the upper tabletop corresponding to the outer column, and the outer tabletop sleeves on the outer column via the first installation hole; the tabletop mounting frame assembly is fixed with the outer column so that the tabletop mounting frame assembly is installed under the upper tabletop to support and fix the upper tabletop;

wherein, the tabletop mounting frame assembly is in a "Z" shape and comprises a tabletop mounting plate, an extending plate and a lower tabletop; a second installation hole is defined at a position of the tabletop mounting frame assembly corresponding to the outer column, and the tabletop mounting frame assembly is fixed to the outer column via the second installation hole; the tabletop mounting plate is arranged under the upper tabletop for supporting and fixing the upper tabletop; and the tabletop mounting plate and the lower tabletop are both arranged in parallel to the upper tabletop, the extending plate is obliquely connected between the tabletop mounting plate and the lower tabletop, and the buttons are arranged on the oblique extending plate.

2. The lifting table according to claim 1, wherein, a side wall of the outer column is provided with mounting cushion blocks.

3. The lifting table according to claim 2, wherein, a bottom of the base is provided with a base mounting plate for fixing and protecting the controller.

4. The lifting table according to claim 1, wherein, the base is of a trapezoidal structure whose bottom is hollow and is used for receiving the controller.

5. The lifting table according to claim 1, wherein, a bottom of the base is provided with a base mounting plate for fixing and protecting the controller.

6. The lifting table according to claim 5, wherein, a top of the outer column protrudes over the upper tabletop.

7. The lifting table according to claim 1, wherein, a display bracket is installed on a top of the outer column.

8. The lifting table according to claim 1, wherein, a top of the outer column protrudes over the upper tabletop.

* * * * *